United States Patent [19]

Grube et al.

[11] 4,070,884

[45] Jan. 31, 1978

[54] PROCESS AND DEVICE FOR DE-SCALING ELONGATED METALLIC BARS DURING CONTINUOUS FORMING

[75] Inventors: Manfred Grube, Bochum; Wilhelm Gorski, Wattenscheid; Heinz Koch, Sprockhovel, all of Germany

[73] Assignee: Fried. Krupp Huttenwerke Ag, Bochum, Germany

[21] Appl. No.: 765,699

[22] Filed: Feb. 4, 1977

[30] Foreign Application Priority Data

Feb. 10, 1976 Germany ..... 2605011

[51] Int. Cl.[2] ..... B21B 45/04

[52] U.S. Cl. ..... 72/39; 29/81 C; 29/81 F; 72/201

[58] Field of Search ..... 29/81 A, 81 F, 81 B; 72/39, 40, 200, 201, 202; 134/9, 15, 64 R, 122 R, 172, 199; 266/113

[56] References Cited

U.S. PATENT DOCUMENTS

| | | | |
|---|---|---|---|
| 2,289,967 | 7/1942 | Johnson et al. | 29/81 A |
| 2,961,741 | 11/1960 | Cizek | 29/81 A |
| 3,163,559 | 12/1964 | Thompson et al. | 134/122 R X |
| 3,189,490 | 6/1965 | Scott | 266/113 X |
| 3,257,835 | 6/1966 | Cofer et al. | 72/202 X |
| 3,409,963 | 11/1968 | Edgecombe et al. | 29/81 A |
| 3,510,065 | 5/1970 | Gigantino et al. | 29/81 A |

FOREIGN PATENT DOCUMENTS

| | | | |
|---|---|---|---|
| 1,928,510 | 12/1970 | Germany | 72/39 |

*Primary Examiner*—E. M. Combs
*Attorney, Agent, or Firm*—Haseltine, Lake & Waters

[57] ABSTRACT

A device and a process for continuous de-scaling of elongated metallic material, particularly steel. The material has front, center and end sections, and the process includes the steps of continuously moving the material in one direction, and shaping, particularly rolling the material, while the material center and end-sections are still subjected to the heat of a furnace, and the material has a plurality of successive areas in longitudinal direction to be de-scaled. The material is treated or de-scaled following the heating and prior to the forming thereof in predetermined cycles for a predetermined time at a predetermined degree at each of the successive areas, by spraying a fluid, particularly a liquid, on the material under high pressure. The de-scaling zone in the areas of the material is displaced in a direction opposite to the movement of the material at a relatively high velocity for the treatment time of the material to be as short as possible in relation to the degree of descaling to be accomplished.

2 Claims, 2 Drawing Figures

PROCESS AND DEVICE FOR DE-SCALING ELONGATED METALLIC BARS DURING CONTINUOUS FORMING

DESCRIPTION OF THE PRIOR ART

The narrowest tolerances required by the consumers of rolling products having an optimum surface quality of the rolling product are not only dependent on the characteristics pertaining to machinery and plant in a hot forming process, but to a great extent also on the forming laws and those properties of the rolling products concerning quality. A uniformly narrow tolerance over the whole of the length of a bar as substratum can only be achieved with certainty when, in addition to the rolling being largely free of tension, the temperature over the length of the bar is substantially constant. Hence the first stand of a continuous rolling train has to be disposed as near to the furnace as possible so that rolling can be carried out "from the furnace." If the rolling material passes the first stant in such a rolling mill, a considerable part of the remaining length of the bar is still in the furnace, so that a considerable loss in temperature, and hence a resulting difference in temperature, over the length of the rolling material is avoided by radiation of heat (German Pat. No. 939,743). However, the disadvantage of such a rolling mill construction is that no conventional de-scaling device can be arranged between the furnace and the rolling mill. I.e. a conventional de-scaling would cool down the rolling material in particular at the edges to too great an extent, since the velocity of the moving bar in the de-scaling device determined by the first rolling stand is too low. For this reason, some of the modern rolling mills are built all over the world without any de-scaling devices. The disadvantage of such mills is that the primary scale is pressed into the surface of the rolling products in the first passes, resulting in a reduction in quality of the surface of the finished rolling product (German Auslegeschrift No. 1,928,510, column 3, lines 17–26).

In another rolling mill plant the bar passes through the de-scaling device after emerging from the furnace at such a high velocity that on the one hand the scale is removed, and on the other hand the spray-on means does not cool the rolling material, particularly at the edges, to too great an extent. However, the disadvantage of this rolling mill plant is that the bar is not rolled at the same temperature over the whole of its length, for while the front edge of the bar material is already in the rollers of the first stand, the remaining area cools down further. This has the detrimental effect that very narrow tolerances cannot be guaranteed. Moreover, there is the risk that secondary scale forms on the end of the de-scaled material dependent on the drawing-in velocity of the material and thus reduces the surface quality (U.S. Pat. No. 2,289,967).

In a third rolling mill plant both the most narrow tolerances must be ensured, while the required surface qualities are to be achieved. In this rolling mill plant the bar material conveyed out of the furnace passes through a de-scaling device at high velocity so that it cannot cool down locally, particularly at its edges, to too great an extent. The bar to be de-scaled is then conveyed in a heating channel or the like, which is arranged in front of the first stand of the rolling mill, or between groups of stands of the rolling mill. While the leading portion is being formed, the remaining portion of the bar remains still in the heating channel. The disadvantage of this rolling mill plant is that a special heating channel is reqired for keeping the rolling material hot during the forming process (German Auslegeschrift No. 1,928,510).

OBJECT OF THE INVENTION

It is an object of the present invention to create a process and a device by means of which the rolling material can be produced at the narrowest tolerances and a high surface quality, but at a low plant expenditure.

SUMMARY OF THE INVENTION

Starting with a process for de-scaling elongated metallic material, in particular steel, which is still positioned with its center and end sections in the hot furnace during continuous forming, particularly during rolling, of its front and then middle sections, and which is de-scaled after being heated and before being formed by a fluid, especially a liquid which is sprayed on under high pressure, the object is solved by the de-scaling being carried out in cycles at each of the successive sections of the material, so that the de-scaling zone on the material is displaced in opposite directions to that of the movement of the material at such a high velocity that the local treatment time of the material with the fluid is as short as possible with respect to the degree of de-scaling which is to be achieved.

A further subject of the invention is a device for the removal of superficial scale from elongated, metallic material, in particular steel, by means of spraying on a fluid, especially a liquid onto the material, which is arranged behind a furnace for uniform heating and ahead of a continuous forming device, in particular a rolling device, the continuous forming device being disposed at a distance from the furnace which is considerably smaller than the length of the material to be formed. Such a device is characterized, according to the invention, by the device for the removal of the superficial scale being movable cylindrically or in rhythm along and in opposition to the direction of the forming, by the spraying device being switched on whilst it is moving in a direction opposite to the direction of movement of the material, the return stroke of the device being carried out when it is switched off.

The invention is based on the fact that the short time action of the sprayed on liquid medium which is necessary for de-scaling the material without undesirable excessive local cooling can be achieved despite a low velocity of movement of the material to be de-scaled when the velocity of movement of the material has superimposed thereon a velocity of the fluid sprayed on the material, which is opposite to the velocity of the material itself. It is this recognition which makes it possible to effectively de-scale elongated material without any detrimental effect on the tolerances when the forming rolls are disposed very close to the furnace discharge opening.

DESCRIPTION OF THE PREFERRED EMBODIMENTS

Figure 1:
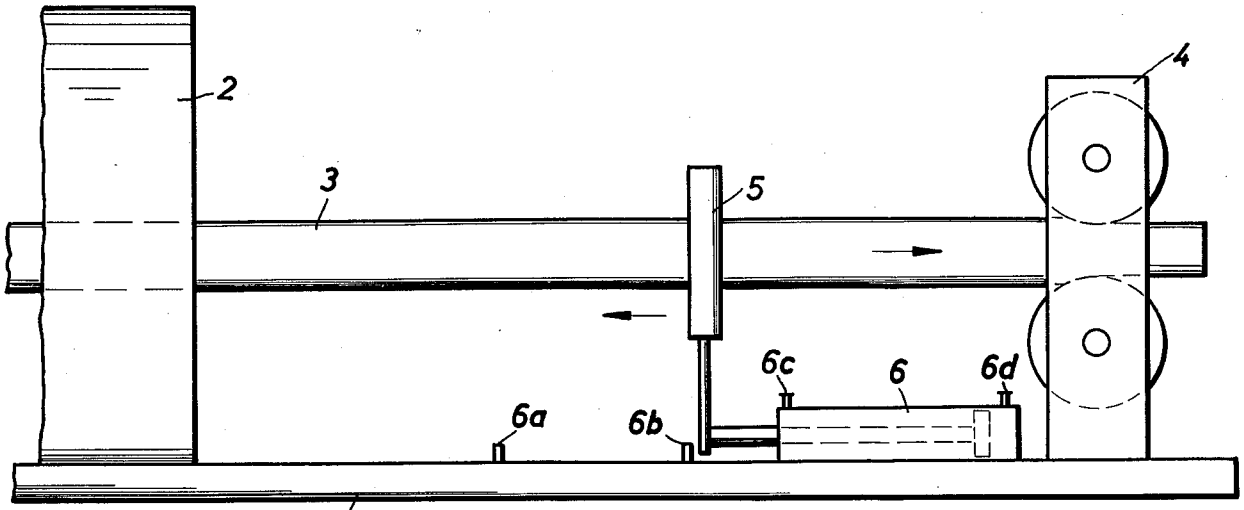
FIG. 1 shows a schematic representation and side view of a device for de-scaling a metallic bar during continuous rolling.

A furnace 2 for a metallic bar 3, a rolling stand 4 and a de-scaling device 5 arranged between the furnace 2 and the rolling stand 4 are constructed on a common console 1. The de-scaling device 5 can be driven forward by means of a driving mechanism 6 in the form of a cylinder, at a relatively high velocity in a direction opposite to that of the metallic bar 3 during spraying on of a de-scaling fluid, i.e. water, and can be driven in a reverse direction at a higher velocity without spraying on the de-scaling fluid, the piston of the driving device being acted upon by pressure on opposite sides. The course is determined by two end switches *6a, 6b* mounted on the console 1. These end switches *6a, 6b* influence a control means (still to be described in detail), which controls the supply of a hydraulic fluid to the terminals *6c, 6d* of the driving mechanism 6. The device 5 for de-scaling is constructed in the usual way: it comprises a framework surrounding the bar 3, which framework has nozzles directed onto the surface of the bar 3. The nozzles are fed with the liquid de-scaling fluid at high pressure.

The distance between the furnace 2 and the rolling stand 4 is selected to be as small as possible in order to leave the bar to be rolled in the furnace as long as possible. The distance amounts to, for example, 1 to 2 m. The course of the device 5 amounts to 0.5 to 0.8 m. So that the de-scaling fluid does not act locally for too long to avoid local excessive cooling at a usual feed velocity of the bar 3 of 0.03 to 1.1 m per second, the de-scaling device 5 is driven at such a high velocity in the opposite direction to that of the movement of the bar 3, that a relative velocity of 2 to 5 m per second results. The de-scaling fluid, which is generally water, is sprayed on at an excess pressure of 80 to 200 atmospheres above atmospheric pressure.

Figure 2:
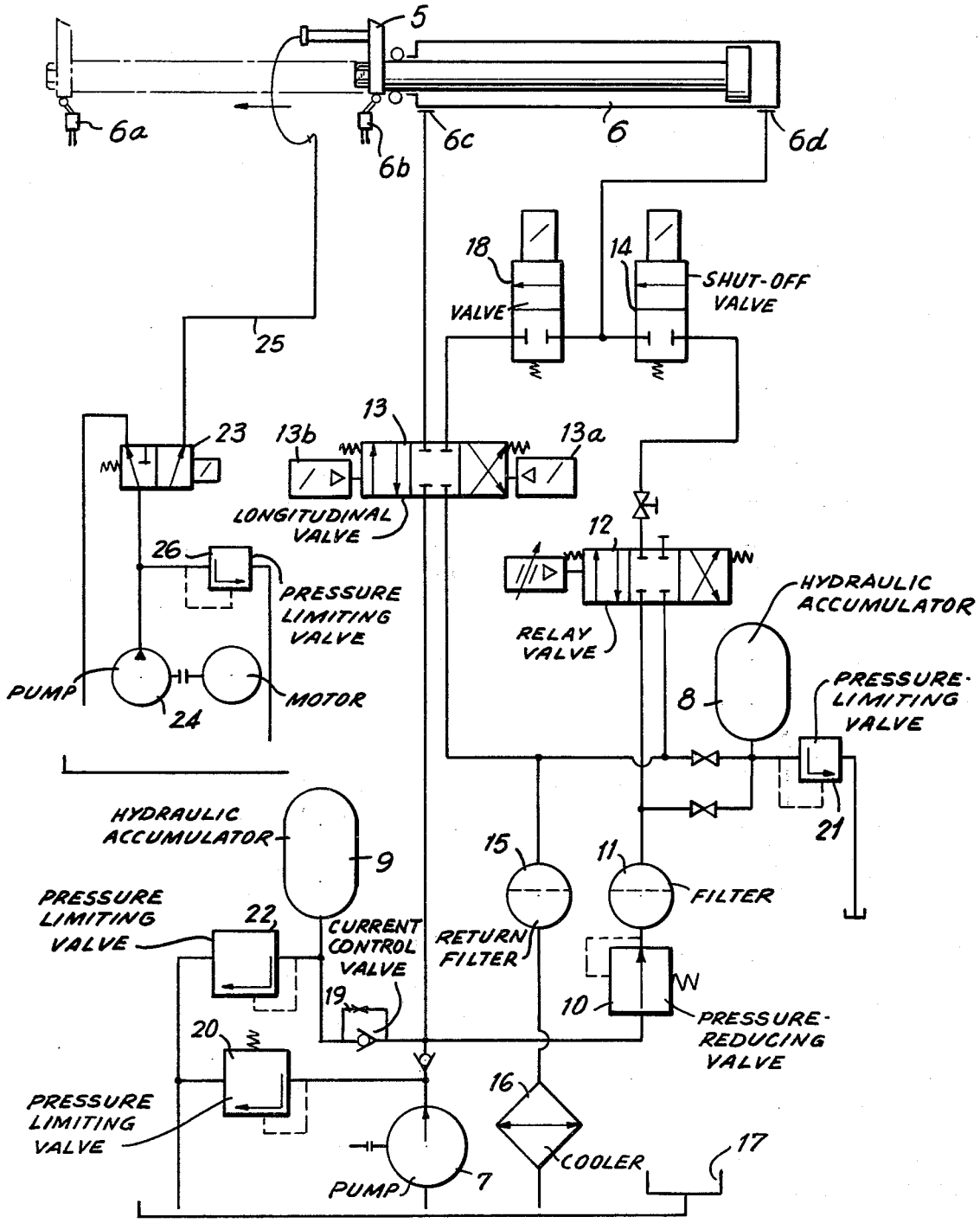
FIG. 2 shows the actuator of the de-scaling device according to FIG. 1, and its hydraulic control mechanism.

According to FIG. 2 the necessary hydraulic pressure is produced by a pump 7 and conveyed to hydraulic accumulators 8, 9. The hydraulic fluid conveyed to the hydraulic accumulator 8 passes through a pressure relief valve 10 and a superfine filter 11.

A relay valve 12, a longitudinal valve 13 at 13*a* and a shut-off valve 14 are activated on the control side at the same time during the de-scaling process. The hydraulic fluid conveyed by the pump 7 and delivered into the hydraulic accumulator 8 passes through the controlled relay valve 12 to the terminal *6d* on the right side of the piston of the cylinder of the driving mechanism 6. The hydraulic fluid emerging from the terminal *6c* of the other side of the piston is returned through the longitudinal valve 13, a return filter 15 and a cooler 16 into a tank 17. The course of the cylinder of the driving mechanism 6 is controlled by means of the end switch *6a* (or a counter) in which the relay or longitudinal or shut-off valves 12, 13 at 13*a*, 14 are de-activated and the return stroke controlled.

The relay valve 12 and the shut-off valve 14 remain de-activated during the fast return stroke. The longitudinal valve 13 at 13*b* and the shut-off valve 14 are activated. The hydraulic medium delivered by the pump 7 and stored in the hydraulic accumulator 9 passes through a current control valve 19 and through the longitudinal valve 13 to the left-hand side of the piston of the driving mechanism 6. The hydraulic fluid returning from the right-hand side of the piston is conveyed to the tank 17 through the valve 18, the longitudinal valve 13, the by-pass valve 15 and the cooler 16. The return velocity of the stroke can be adapted to the complete working cycle by means of the electrically controlled relay valve 12. When the end switch *6b* has been reached, the longitudinal valve 13 at 13*b* and the valve 18 are de-activated and a new cycle of operation is introduced.

A pressure limiting valve 20 is provided for the protection of the hydraulic device against overloading. The hydraulic accumulators 8, 9 are protected by pressure limiting valves 21 and 22.

A valve 23 for the de-scaling fluid (water) is activated at the same time as the relay valve 12 is activated. The de-scaling fluid conveyed by a pump 24 passes through a tubular conduit 25 to the device 5 for de-scaling. The activated end switch *6a* de-activates the valve 23. The de-scaling fluid conveyed by the pump 24 circulates during the return stroke of the piston of the driving mechanism 6 and has no pressure applied thereto. A de-scaling fluid is only conveyed to the device 5 through the activated valve 23 on the way from the end switch *6b* to end switch *6a*.

A pressure limiting valve 26 is provided for the protection of the pump 24.

While there has been shown what is considered to be the preferred embodiment of the invention, it will be obvious that modifications may be made which come within the scope of the disclosure of the specification.

We claim:

1. A process for continuous de-scaling of elongated metallic material, particularly steel, said material having a plurality of successive areas disposed in a longitudinal direction to be de-scaled; said material being defined by a leading section, trailing sections and a section therebetween, said process comprising the steps of:

continuously moving said material in one direction, and simultaneously shaping, particularly by rolling, said material; shaping said material leading section, and subsequently said section between said leading and trailing sections; heating said section between said leading and trailing sections and said trailing sections by the heat of a furnace during the shaping of said leading section;

spraying a fluid, particularly a liquid, within a de-scaling zone on the material under high pressure in a predetermined cycle for a predetermined treatment time at a predetermined degree at each of the successive areas during material movement and prior to said material shaping; and displacing the de-scaling zone in the areas of the material in a direction opposite to the movement of the material at a relatively high velocity enabling material treatment time to be minimized in relation to a quantum of de-scaling.

2. An apparatus for de-scaling the surface scale of an elongated matallic material, particularly steel, by spraying a liquid medium thereon, comprising:

a furnace for uniform heating of the elongated material passing therethrough;

continuous forming means in particular, rolling means, for receiving said material, disposed at a predetermined distance from said furnace, said material being formed by said forming means having a predetermined length; said distance being smaller than the length of the material to be formed; said material being movable in a predetermined direction and liquid spraying means mounted for reciprocation in a direction opposite to said predetermined direction during a de-scaling cycle as said fluid de-scaling medium is being sprayed on said material; and means acting upon said spraying means for displacing said means to a point of origin in response to the end of said de-scaling cycle.

* * * * *